US005151573A

United States Patent [19]

Masuda

[11] Patent Number: 5,151,573

[45] Date of Patent: Sep. 29, 1992

[54] IMAGE FORMING APPARATUS

[75] Inventor: Shunichi Masuda, Kawasaki, Japan

[73] Assignee: Canon Kabushiki Kaisha, Tokyo, Japan

[21] Appl. No.: 731,873

[22] Filed: Jul. 18, 1991

[30] Foreign Application Priority Data

Jul. 24, 1990 [JP] Japan ..... 2-195879

[51] Int. Cl.[5] ..... G03G 15/20

[52] U.S. Cl. ..... 219/216; 355/285

[58] Field of Search ..... 219/216, 469, 470, 471; 355/285

[56] References Cited

U.S. PATENT DOCUMENTS

| | | | |
|---|---|---|---|
| 3,445,626 | 5/1969 | Michaels | 219/216 |
| 3,502,407 | 3/1970 | Granzow | 355/285 |
| 3,881,085 | 4/1975 | Traister | 219/216 |
| 3,946,199 | 3/1976 | Nakamura | 219/216 |
| 4,113,375 | 9/1978 | Murata | 355/285 |
| 4,226,514 | 10/1980 | Anfilov | 355/285 |
| 4,914,476 | 4/1990 | Nishitsuji | 219/216 |
| 4,937,600 | 6/1990 | Hirabayashi et al. | 346/160.1 |

*Primary Examiner*—Teresa J. Walberg

*Attorney, Agent, or Firm*—Fitzpatrick, Cella, Harper & Scinto

[57] ABSTRACT

Disclosed is an image forming apparatus having a thermal fixing unit and a cooling fan. There is an input device for inputting print data which is sent from an external apparatus; a timer for starting an operation upon completion of an image forming operation; and a controller for controlling the thermal fixing unit and the cooling fan on the basis of an operating state of the timer.

9 Claims, 5 Drawing Sheets

IMAGE FORMING APPARATUS

BACKGROUND OF THE INVENTION

1. Field of the Invention

The present invention relates to an image forming apparatus having a thermal fixing apparatus.

2. Related Background Art

In recent years, an image forming apparatus having a thermal fixing apparatus, particularly, a laser printer, are in wide use in many offices and homes in association with the miniaturization and light weight of the apparatus.

In the printer using the thermal fixing apparatus, a print quality of an output image is excellent as compared with print qualities of the other recording apparatuses such as thermal printer, ink jet printer, and the like and is an apparatus which is indispensable at present.

The thermal fixing apparatus has a heater of a thermal energy within a range from tens of W to a few KW. Hitherto, to keep a predetermined temperature so long as a power supply of the apparatus is on, it is necessary to control the on/off operation of the heater.

Further, to prevent an influence on the whole apparatus by a heat of the thermal fixing apparatus, the cooling fan and the like also need to be constantly driven.

On the other hand, so long as the power supply to the apparatus is on, the heater as a thermal source and the driving system such as a fan and the like are also simultaneously turned on.

As mentioned above, however, in a situation such that a number of laser printers are widely spread in homes and offices, in the case of using the apparatus for a period of time from a few months to a few years without turning off a power supply of the apparatus, there is a problem on safety to a thermal source and there is also a disadvantage such that a life and the like of a driving system such as a cooling fan and the like are also reduced.

SUMMARY OF THE INVENTION

It is an object of the invention to solve the foregoing problems.

Another object of the invention is to provide an image forming apparatus which can solve the safety problem from the power supply remaining on for a long time and can also extend the life of a driving system such as a cooling fan and the like.

Still another object of the invention is to improve a thermal fixing apparatus of an image forming apparatus.

According to a preferred embodiment of the invention, after completion of the operation of timer means after the print operation of an image forming apparatus had been completed, a heater of a thermal fixing apparatus and a driving system such as a cooling fan and the like are turned off, so that the safety of the apparatus can be improved, the electric power consumption of the driving means can be reduced, and the life of the driving system can be extended.

In the case where an input of print data and an input of operation key have been judged, by turning on the heater and the driving means such as a cooling fan and the like, the start/stop of the apparatus can be controlled without needing to turn on/off the power supply of the apparatus by the user.

Further, if the use of the image forming apparatus by the user such as print data input, operation key input, etc. has been detected during the operation of timer means, the timer means is reset and, at the same time, the timer means is again made operative, so that a proper timer operation can be performed.

The above and other objects and features of the present invention will become apparent from the following detailed description and the appended claims with reference to the accompanying drawings.

DETAILED DESCRIPTION OF THE PREFERRED EMBODIMENTS

An embodiment of the invention will be described in detail hereinbelow with reference to the drawings.

Figure 1:
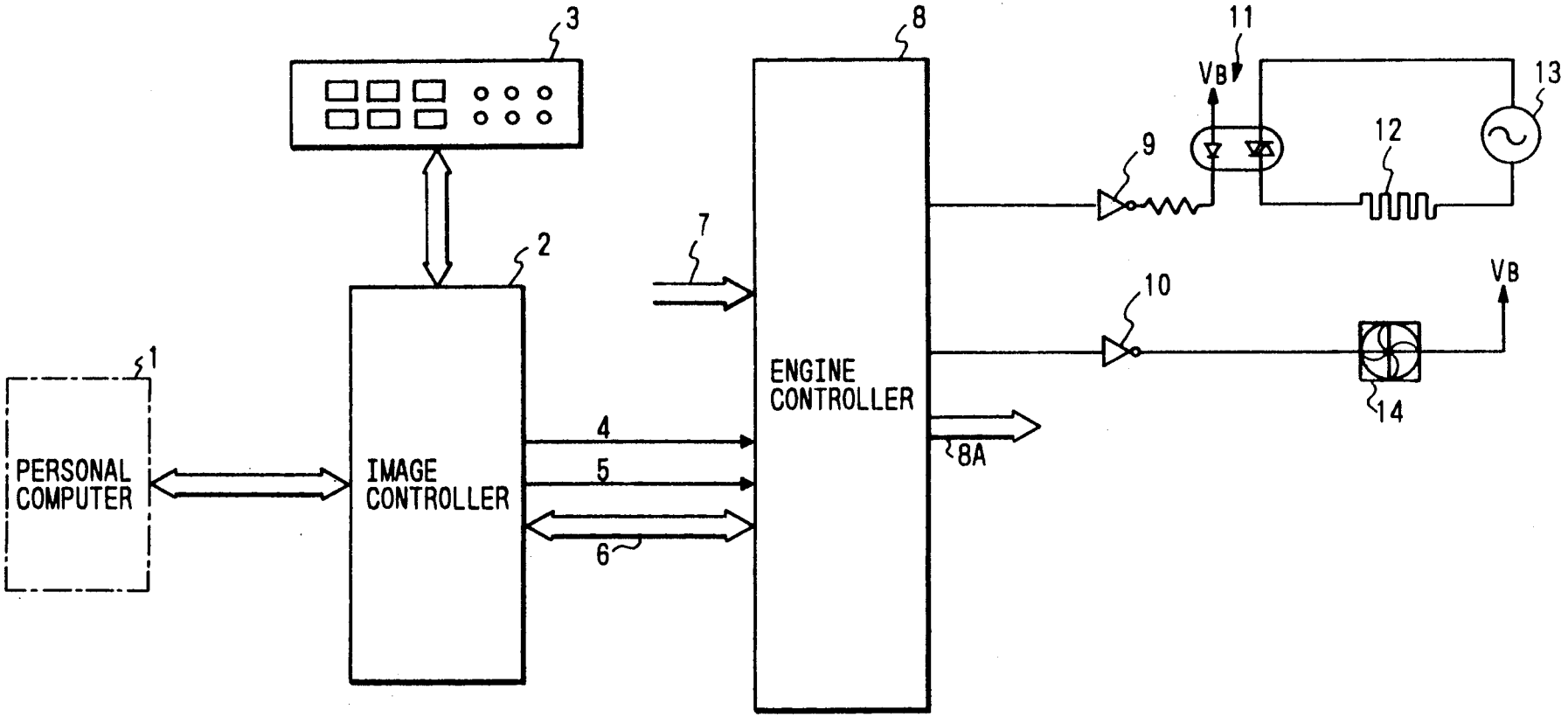
FIG. 1 is a block constructional diagram showing an embodiment of the invention.

FIG. 1 is a block constructional diagram showing an embodiment of the invention.

In the diagram, a personal computer 1 is connected to an image controller 2 in a laser printer through a communication cable by a well-known interface such as centronics, RS232C, or the like.

The image controller 2 is a control section to develop and control code data which is sent from the personal computer 1 through the interface into a dot image.

The image controller 2 is also connected to a control panel 3 and discriminates operator information supplied from the control panel 3 and generates a command to an engine controller 8.

Further, a heater-on signal 4 and a printer start command signal 5 are sent from the image controller 2 to the engine controller 8. Dot image data is communicated as a video signal through a signal line 6. Status signals and the like of the image controller 2 and the engine controller 8 are also communicated through the signal line 6.

The engine controller 8 is a control section to control an image forming process. In order to execute a paper conveyance control, an electro-photographing process control, a laser driver control, and the like (not shown), a control input 7 is supplied from a sensor or the like to the engine controller 8. A control output 8A to drive each of the above controls is generated from the engine controller 8. A signal to turn on a heater 12 of the thermal fixing apparatus is generated from the engine controller 8, thereby turning on the heater 12 through a driver 9 and a photo TRIAC 11. Further, a driving signal for a cooling fan 14 to cool the insides of the thermal fixing apparatus and the image forming apparatus is supplied from the engine controller 8 to the cooling fan 14 through the driver 10.

Figure 2:
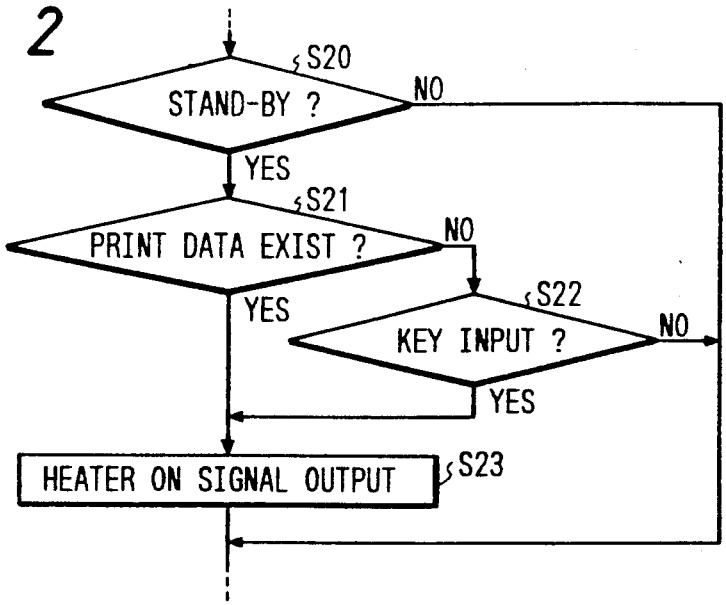
FIG. 2 is a flowchart showing a part of the operation of an image controller in the embodiment.

FIG. 2 is a flowchart showing a part of the operation in the image controller 2.

A check is first made to see if the laser printer is in a stand-by mode, namely, a state in which the print operation is not performed when the power supply is turned on (S20). If YES, a check is made to see if print data has been sent from the personal computer 1 or not (S21).

If there is print data, the heater on signal 4 is supplied to the engine controller 8 (S23).

If there is no print data in step S21, a check is made to see if there is a key input from the control panel 3 (S22). If YES, step S23 follows and the output operation of the heater on signal 4 is executed.

Figure 3:
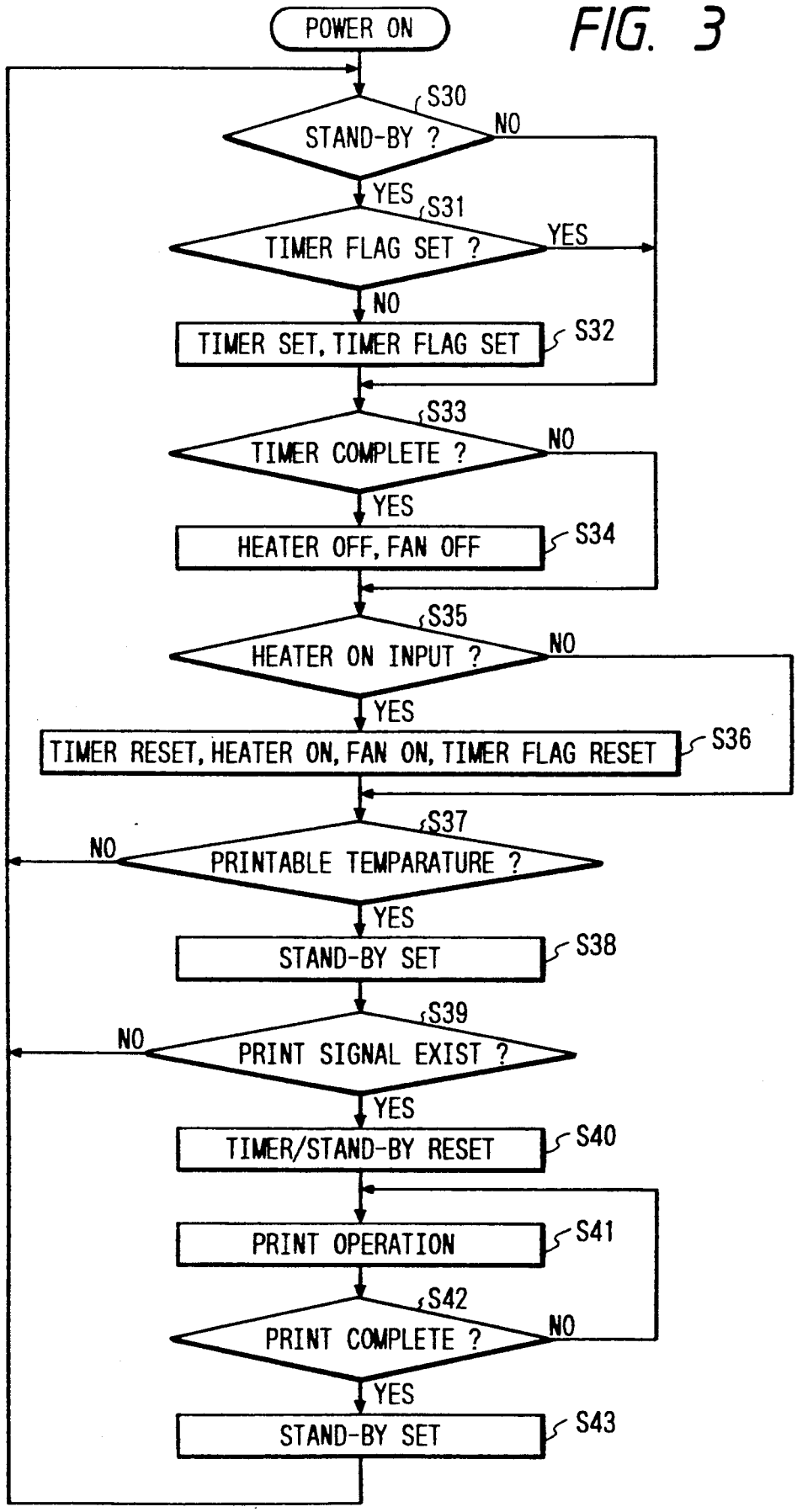
FIG. 3 is a flowchart showing the operation of an engine controller in the embodiment.

FIG. 3 is a flowchart showing the operation of the engine controller 8.

Figure 4:
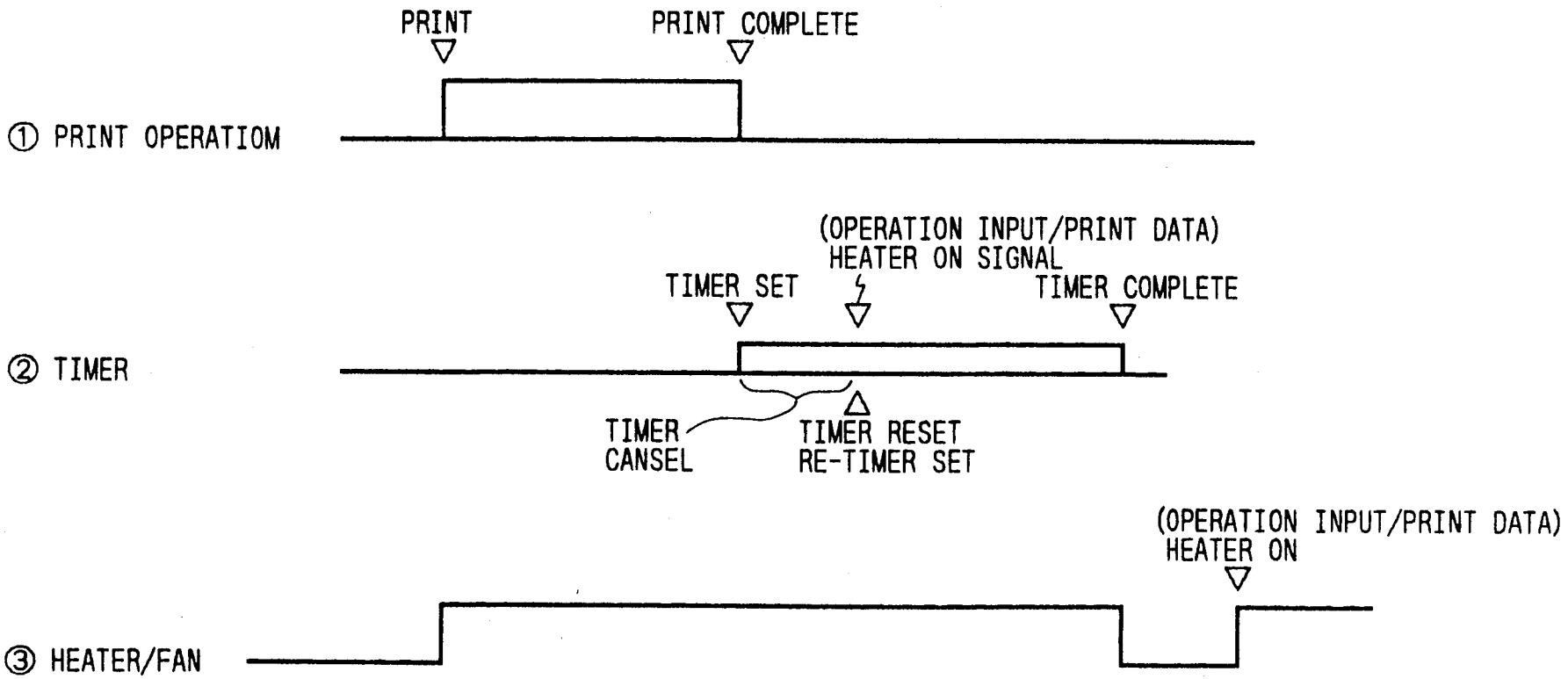
FIG. 4 is a timing chart showing the print operation and the operations of a timer, a heater, and a fan in the embodiment.

FIG. 4 is a timing chart showing the print operation and the operations of the timer, heater 12, and fan 14.

First, a check is made to see if the apparatus is in the stand-by mode (S30). If YES, a check is made to see if a timer flag has been set or not (S31). The timer flag is set when the timer has operated. The discriminating step S31 is executed so as to prevent the timer flag from being overlappingly set in step S32.

The timer flag is set (S32) simultaneously with that the timer has been set. A check is made to see if the set timer has been completed (S33). If YES, the heater 12 and the fan 14 are turned off (S34).

A check is made to see if the heater on signal 4 has been sent from the image controller 2 (S35). If YES, the timer is reset and the heater 12 and the fan 14 are turned off.

A check is now made to see if a temperature of the thermal fixing apparatus has reached a printable temperature or not (S37). It is now assumed that the heater 12 and the fan 14 are turned on after the power supply of the apparatus was turned on. Therefore, the operations in steps S30→S33→S35→S37 are repeated until the temperature of the thermal fixing apparatus reaches the printable temperature after the power supply was turned on.

If the temperature of the thermal fixing apparatus has reached the printable temperature, a stand-by flag indicative of the stand-by mode is set (S38). After the stand-by flag was set, a check is made to see if the print start command signal 5 has been supplied from the image controller 2 (S39). If NO, the processing routine advances to steps S30, S31, S32, and the like and the timer is made operative. That is, if the temperature of the thermal fixing apparatus has reached the printable temperature after the power supply of the apparatus was turned on, the timer is made operative. If the print data has been received or the operation key has been input and the like, the timer is cancelled and the timer is reset at the above time point. A time of the timer in the above case is properly set to a value within a range from tens of minutes to a few hours. It is also possible to set different timer times for the fan and the heater.

If the print signal 5 has been supplied (S39), the timer and the stand-by flag are reset (S40) and the print operation is executed (S41).

A check is made to see if the print operation has been completed or not (S42). If YES, the standby flag is set (S43). Namely, after completion of the print operation, the stand-by flag is set, so that the timer is set in steps S30, S31, and S32.

Figure 5:
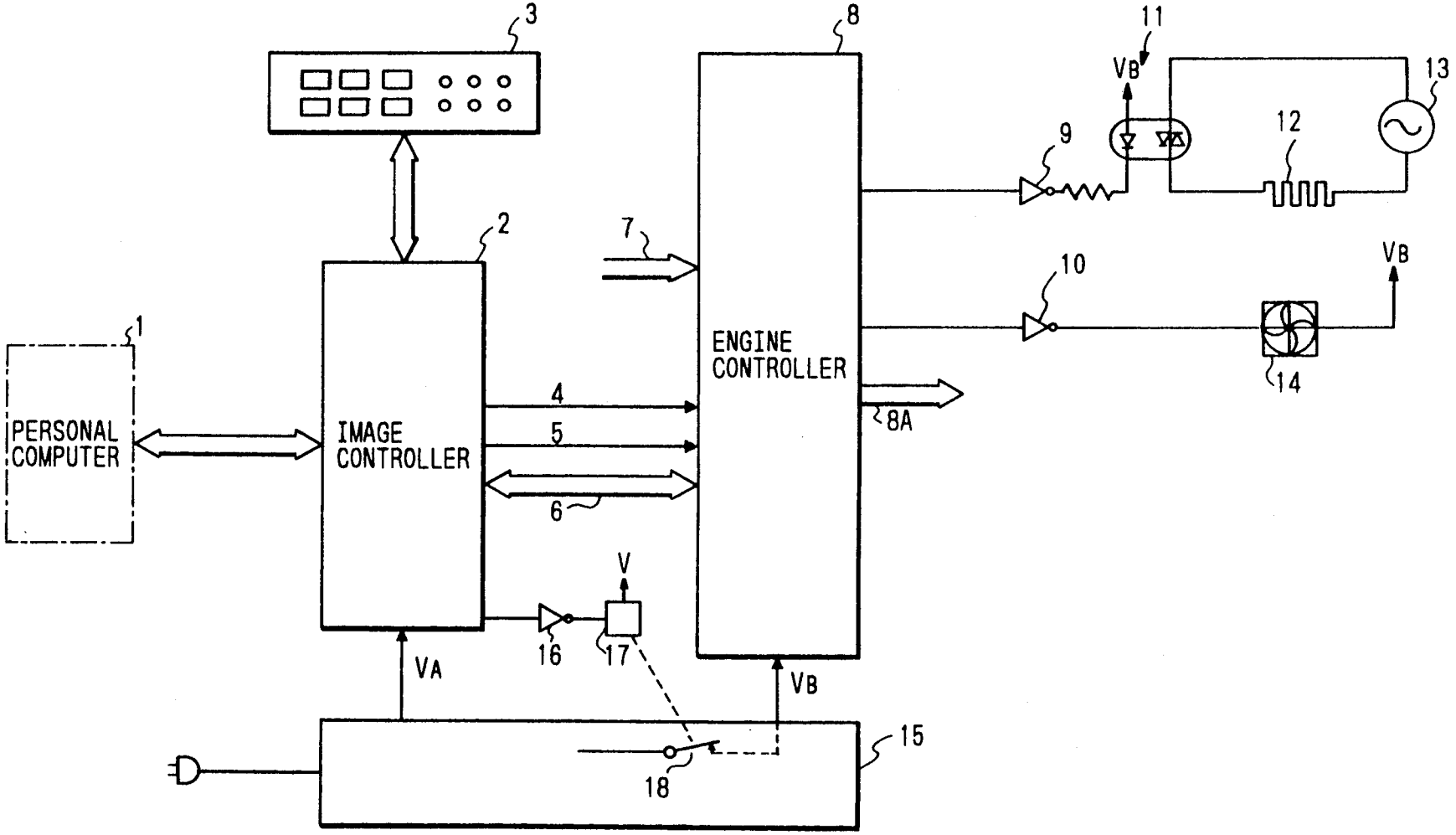
FIG. 5 is a block diagram showing another embodiment of the invention.

FIG. 5 is a block diagram showing another embodiment of the invention.

According to the apparatus of this embodiment in addition to the construction of FIG. 1, there is provided a driver 16 to drive a power supply section 15 and the relay 17 and a relay contact 18 which is provided in the power supply and turns on/off the engine controller 8 and another driving power supply $V_B$.

In the embodiment, timer means is provided for the image controller 2. If no print data is supplied and no key input is sent from the control panel 3, the relay 17 is made operative, thereby turning off the engine controller 8 and the driving power supply $V_B$.

Figure 6:
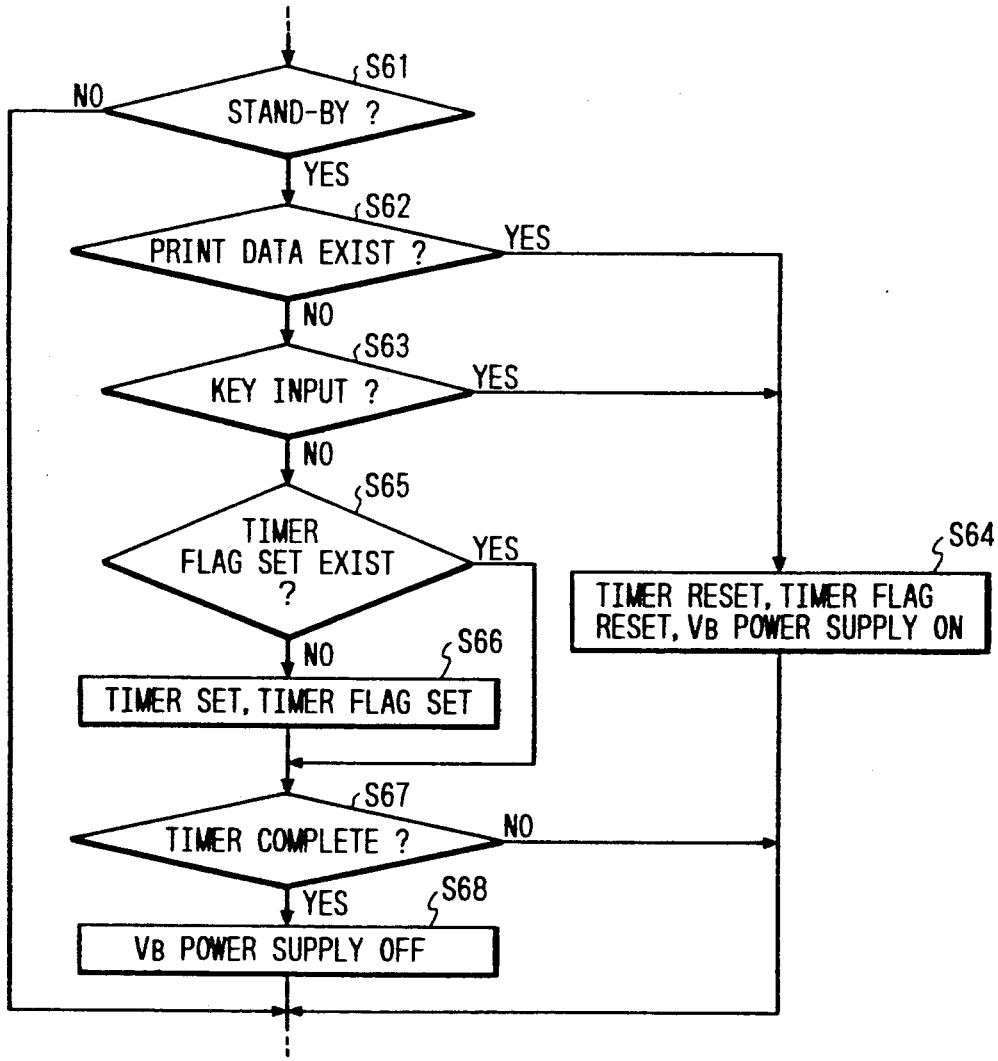
FIG. 6 is a flowchart showing a part of the operation of the image controller in the embodiment.

FIG. 6 is a flowchart showing a part of the operation of the image controller 2.

If the apparatus is in the stand-by mode (S61), a check is made to see if the print data or the operation key input exists or not (S62, S63). If either one of the print data and the operation key input exists, the timer and the timer flag are reset and the engine controller 8 and the driving power supply $V_B$ are turned on (S64).

If the print data or the operation key input doesn't exist, a check is made to see if the timer flag has been set or not (S65). If the timer flag is not set, the timer and the timer flag are set (S66).

If the operation of the timer has been completed (S67), the power supply $V_B$ is turned off (S68).

According to the invention, after completion of the operation of the timer means after the print operation of the image forming apparatus had been completed, the heater of the thermal fixing apparatus and the driving system such as a cooling fan and the like are turned off. Thus, there are effects such that the safety of the apparatus can be improved, the electric power consumption of the driving means can be reduced, and the life of the driving system can be extended.

On the other hand, if the existence of the print data or the operation key input has been determined, by turning on the heater and the driving means such as a cooling fan or the like, the operating efficiency can be improved without needing to turn on/off the power supply of the apparatus by the user.

The foregoing embodiments are merely examples and the invention is not limited to the foregoing embodiments but many modifications and variations are possible within the spirit and scope of the appended claims of the invention.

I claim:

1. An image forming apparatus having thermal fixing means and a cooling fan, comprising:

input means for inputting print data which is sent from an external apparatus;

timer means for starting a timing operation upon completion of an image forming operation; and control means for controlling the thermal fixing means and the cooling fan on the basis of counted time of the timer means, wherein said control means turns off the thermal fixing means and the cooling fan when the timer means has counted a predetermined time without starting a next image forming operation.

2. An apparatus according to claim 1, wherein said control means controls an on/off operation of a power supply including the thermal fixing means and the cooling fan driving system on the basis of the counted time of the timer means.

3. An apparatus according to claim 1, wherein said control means sets different predetermined times for the thermal fixing means and the cooling fan.

4. An apparatus according to claim 1, wherein said control means resets the timer means when the input means has inputted the print data.

5. An apparatus according to claim 1, wherein said control means turns on the thermal fixing means and the cooling fan when the timer means has been reset.

6. An apparatus according to claim 1, further comprising an operation panel which is operated by an operator, and wherein said control means resets the timer means when the operation panel has been operated.

7. An image forming apparatus having thermal fixing means and a cooling fan, comprising:

input means for inputting print data which is sent from an external apparatus; and control means for controlling the thermal fixing means and the cooling fan, wherein said control means turns off the thermal fixing means and the cooling fan when a predetermined time has passed from a completion of an image forming operation without starting a next image forming operation.

8. An image forming apparatus having thermal fixing means and a cooling fan, comprising:

input means for inputting print data which is sent from an external apparatus;

an operation panel which is operated by an operator; and timer means for counting a time on the basis of which the thermal fixing means and the cooling fan are controlled, wherein said timer means starts a count operation upon any one of (a) completion of an image formation operation, (b) receipt of print data input by the input means, and (c) operation of the operation panel.

9. An image forming operation according to claim 8, wherein said apparatus turns off the thermal fixing means and the cooling fan when the timer means time-counts a predetermined time.

* * * * *

UNITED STATES PATENT AND TRADEMARK OFFICE

CERTIFICATE OF CORRECTION

PATENT NO. : 5,151,573

DATED : September 29, 1992

INVENTOR(S) : SHUNICHI MASUDA

It is certified that error appears in the above-identified patent and that said Letters Patent is hereby corrected as shown below:

IN THE DRAWINGS:

Figure 3

"TEMPARATURE" should read --TEMPERATURE--.

Figure 4

"OPERATIOM" should read --OPERATION--.
"CANSEL" should read --CANCEL--.

COLUMN 1

Line 10, "a laser printer," should read --laser printers--.

COLUMN 3

Line 3, "heater on" should read --heater-on--.

UNITED STATES PATENT AND TRADEMARK OFFICE

CERTIFICATE OF CORRECTION

PATENT NO. : 5,151,573

DATED : September 29, 1992

INVENTOR(S) : Shunichi Masuda

It is certified that error appears in the above-indentified patent and that said Letters Patent is hereby corrected as shown below:

Column 3, line 8, "heater on" should read --heater-on--.

line 23, "heater on" should read --heater-on--.

Signed and Sealed this

Sixteenth Day of November, 1993

*Attest:*

*Attesting Officer*

BRUCE LEHMAN

*Commissioner of Patents and Trademarks*